United States Patent [19]

Brian

[11] Patent Number: 4,966,075

[45] Date of Patent: Oct. 30, 1990

[54] MULTI-COLOR PRINTING METHOD AND APPARATUS WITH REGISTRATION MEANS

[75] Inventor: David A. Brian, Huddersfield, England

[73] Assignee: Cobden Chadwick Limited, Oldham, England

[21] Appl. No.: 399,338

[22] Filed: Aug. 28, 1989

Related U.S. Application Data

[63] Continuation of Ser. No. 294,969, Jan. 5, 1989, abandoned, which is a continuation of Ser. No. 43,782, Apr. 29, 1987, abandoned.

[30] Foreign Application Priority Data

May 1, 1986 [GB] United Kingdom ..... 8610688

[51] Int. Cl.[5] ..... B41M 1/14

[52] U.S. Cl. ..... 101/211; 101/181; 101/228; 101/485; 101/490

[58] Field of Search ..... 101/181, 182, 184, 185, 101/228, 211, 483, 485, 490; 226/118, 119, 152

[56] References Cited

U.S. PATENT DOCUMENTS

| | | | |
|---|---|---|---|
| 2,845,860 | 8/1958 | Mestre | 101/185 |
| 3,049,076 | 8/1962 | Ritzerfeld et al. | 101/185 X |
| 3,397,639 | 8/1968 | Betts et al. | 101/228 X |
| 3,473,468 | 10/1969 | Vandeman et al. | 101/184 X |
| 3,605,618 | 9/1971 | Clasen | 101/228 |
| 3,694,634 | 9/1972 | Horst et al. | 101/181 X |
| 3,896,377 | 7/1975 | Rieardsen | 101/181 X |
| 3,921,519 | 11/1975 | Zimmer | 101/181 X |
| 4,071,178 | 1/1978 | Copp | 226/119 X |
| 4,334,471 | 6/1982 | Noyes et al. | 101/228 |
| 4,448,125 | 5/1984 | Kawaguchi et al. | 101/185 |
| 4,482,972 | 11/1984 | Lewis et al. | 101/181 X |
| 4,592,278 | 6/1986 | Tohuno et al. | 101/228 X |
| 4,690,051 | 9/1987 | Kishine et al. | 101/181 X |

FOREIGN PATENT DOCUMENTS

| | | | |
|---|---|---|---|
| 0084939 | 8/1983 | European Pat. Off. | 101/185 |
| 527312 | 6/1931 | Fed. Rep. of Germany | 101/185 |

*Primary Examiner*—Edgar S. Burr
*Assistant Examiner*—Moshe I. Cohen
*Attorney, Agent, or Firm*—Armstrong, Nikaido, Marmelstein, Kubovcik & Murray

[57] ABSTRACT

A method of printing a succession of images on to an elongate web, in at least two colors, comprises feeding the web past the first and second rotating printing cylinders 10 and 11, the first print cylinder applying a first color and the second print cylinder applying a second color, and periodically interrupting the movement of the web past the print cylinders, the length of the interruptions controlling the repeat distance, and the interruptions of the movement of the web past the second cylinder being controlled in dependence upon the images being produced by the preceding print cylinder. The web may be driven by means of a servo motor such that the extent to which the web moves while the motor accelerates to and/or decelerates from, its normal running speed is accurately predetermined.

16 Claims, 2 Drawing Sheets

MULTI-COLOR PRINTING METHOD AND APPARATUS WITH REGISTRATION MEANS

This application is a continuation of application Ser. No. 294,969 filed Jan. 5, 1989, now abandoned, which is a continuation of application Ser. No. 043,782 filed Apr. 29, 1987, now abandoned.

The invention relates to printing, and particularly to the printing of a succession of images on to an elongate web.

Such printing is commonly done by feeding a web past a rotating print cylinder which bears a printing plate. However when this method is used, the repeat distance, i.e. the distance between any point on one image and the identical point on the succeeding image, is of course dependent on the circumference of the print cylinder. Thus if one wishes to vary the repeat distance, for example in order to change from the printing of a succession of images of one size to the printing of a succession of larger or smaller images, it is necessary to change the cylinder.

Changing of the print cylinder is commonly carried out in practice, but because of the time taken to change the cylinder, it is normally only economic to employ this method of printing when long print runs are involved. With short print runs, it is necessary to use an alternative technique, for example a technique involving periodic interruption of the movement of the web past the print cylinder, the length of the interruptions controlling the repeat distance.

The known method of interrupting the movement of the web works reasonably satisfactorily when one colour is being used, but the method is not easy to use if two-colour printing is required and it is virtually impossible to print using a large number of colours, because of the difficulties of synchronising the various colour images.

Difficulties also arise with the known methods because of slippage in the clutch brake mechanisms which are commonly used to drive the web.

The invention seeks to provide a method of printing which overcomes or reduces the above-mentioned problems.

According to a first aspect of the invention, a method of printing a succession of images on to an elongate web, in at least two colours, comprises feeding the web past first and second rotating print cylinders, the first print cylinder applying a first colour and the second print cylinder applying a second colour, and periodically interrupting the movement of the web past the print cylinders, the length of the interruptions controlling the repeat distance, and the interruptions of the movement of the web past the second cylinder being controlled in dependence upon the images being produced by the preceding print cylinder.

Preferably there is an an accumulator device between the two print cylinders.

Preferably there is a first web drive means associated with the first print cylinder and second web drive means associated with the second print cylinder.

Preferably a cycle commences with each web drive means being started simultaneously, for example by a switch device activated by one of the rotating print cylinders.

Preferably the first drive means is stopped after the web has moved a predetermined distance past the first print cylinder.

Preferably the second drive means is associated with a detection device for detecting an image produced by the first print cylinder and is stopped after the web has travelled the predetermined distance after the said detection device has detected an image.

The said predetermined distances are preferably measured using a digital encoding device which produces a digital count related to the distance moved by the web.

Preferably means are provided for presetting a desired count relating to a desired distance and comparing the count with the count produced by the digital encoding device.

According to a second aspect of the invention, a method of printing a succession of images on to an elongate web comprises feeding the web past a rotating print cylinder and periodically interrupting the movement of the web past the print cylinder, the web being driven by means of a servo motor such that the extent to which the web moves while the motor accelerates to, and/or decelerates from, its normal running speed is accurately predetermined.

The servo motor may have a digital encoder associated therewith.

The invention includes apparatus for use in carrying out the methods of the invention.

By way of example, a specific embodiment of the invention will now be described, with reference to the accompanying drawings in which.

Figure 1:
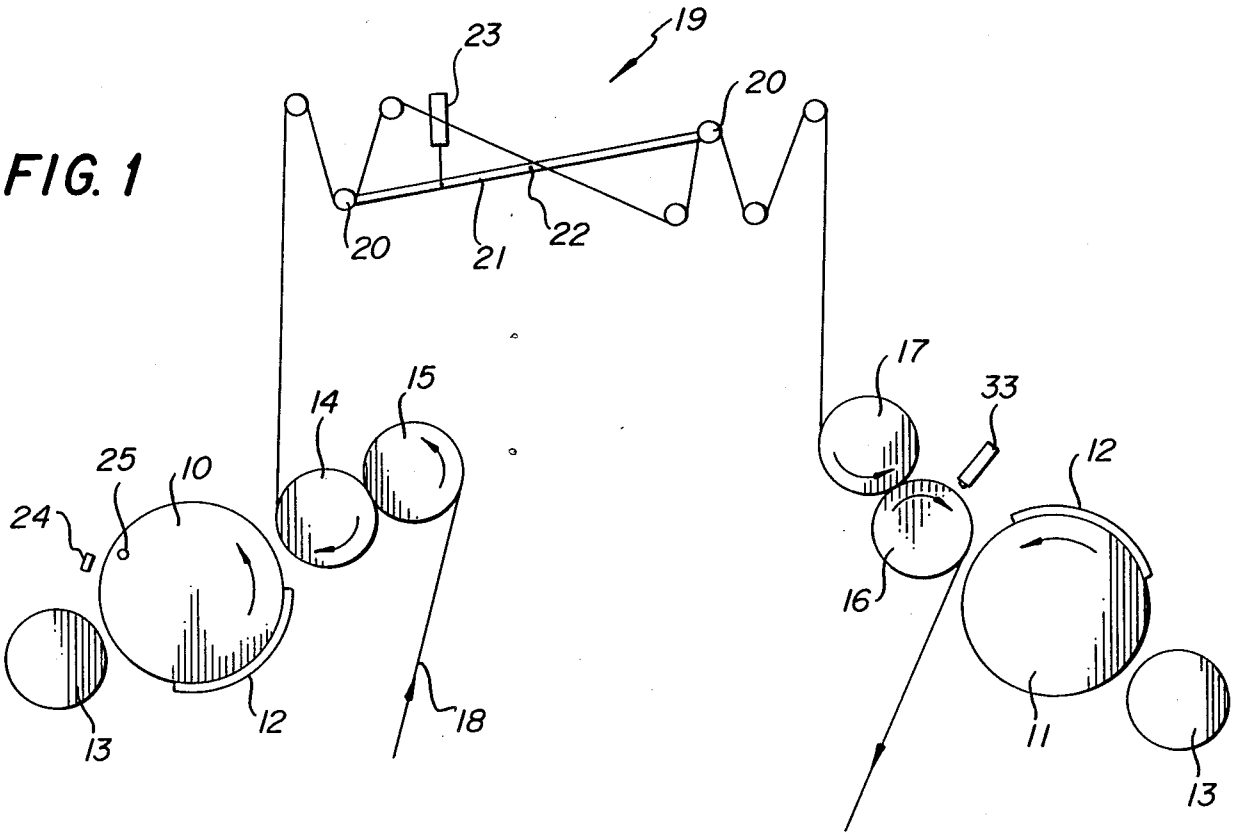
FIG. 1 is a diagrammatic side view of an embodiment of printing apparatus suitable for carrying out the method according to the invention.

The apparatus shown in FIG. 1 has two print cylinders 10 and 11. Each carries a printing plate 12 which extends over only a part of the circumference of the associated print cylinder. Each print cylinder is associated with an ink roller 13.

Adjacent to the print cylinder 10 there is a pair of nip rollers 14 and 15, the roller 14 also acting as an impression cylinder. There is a similar pair of rollers 16 and 17 adjacent to the print cylinder 11, the roller 16 also acting as an impression cylinder.

The rollers are of substantial width, for example up to 3 meters wide. A web of material to be printed, for example plastics material (e.g. polythene) for use in the manufacture of bags, is shown in FIG. 1 by the reference numeral 18. The material 18 passes from a payout reel (not shown) around the rollers 15 and 14 and then through a conventional accumulator device 19. After emerging from the accumulator device 19 the web passes around the nip rollers 17 and 16.

The accumulator device 19 comprises several fixed rollers, and a pair of rollers 20 mounted at each end of an arm 21 which is pivoted at 22. The arm 21 is biased into a position in which tension is applied to the web by an air cylinder 23.

The accumulator device 19 introduces a delay in the web reaching the second print cylinder 11, thus giving time for the images produced by the first print cylinder 10 to dry. The accumulator device also enables the movement of the web past the second print cylinder to fluctuate with respect to the movement of the web past the first print cylinder, so that the movement of the web past the second print cylinder can be controlled independently of the movement of the web past the first print cylinder.

A proximity switch 24 is positioned adjacent to the print cylinder 10 and there is an activating device 25 on the print cylinder 10.

Figure 2:
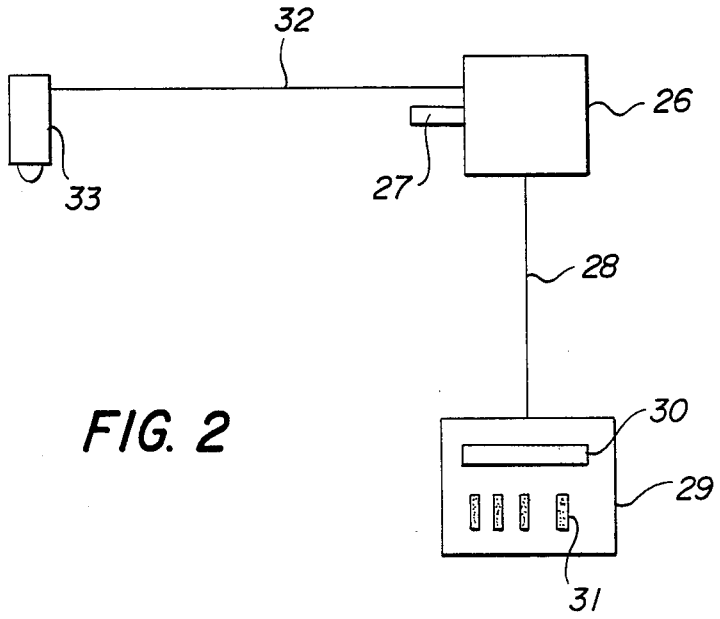
FIG. 2 is a more detailed diagrammatic view of part of the apparatus.

Each pair of nip rollers is associated with a digital encoder such as that shown at 26 in FIG. 2. Each digital encoder is such that when its shaft 27 is rotated by one of the nip rollers, the digital encoder 26 emits electric pulses to a rate related to the rate of rotation of the associated nip roller. These pulses are transmitted via a line 28 to an associated comparator 29 on which a predetermined count may be preset, and visually displayed in a window 30, using thumb wheels 31.

The digital encoder 26 which is associated with the nip rollers 16 and 17 is also connected via a line 32 to an electronic detection device 33, for example in the form of an infra-red or photoelectric eye, which is positioned adjacent to the nip roller 16 as shown in FIG. 1.

The apparatus can be used with various different sizes of printing plate 12. Movement of the web 18 can be interrupted when the printing plates 12 are not in contact with the web 18 so that lengths of web are not wasted, even when the printing plates 12 extend over a very small proportion of the periphery of the print cylinders 10 and 11.

The print cylinders 10 and 11 are driven continuously. The nip rollers 14, 15, 16 and 17 are driven intermittently using servo motors as described in more detail below.

A cycle commences when the actuating device 25 on the print cylinder 10 passes the proximity switch 24. The relative positions of the actuating device 25 and proximity switch 24 are adjusted so that the proximity switch is actuated just before the leading edge of the printing plate 12 on print cylinder 10 comes into contact with the web 18.

Actuation of the proximity switch 24 simultaneously switches on the servo motors driving both pairs of nip rollers.

Movement of the web 18 through the nip rollers 14 and 15 continues until the encoding device 26 associated with the nip rollers 14 and 15 delivers to the comparator 29 a digital count corresponding to the count that has been preset in the window 30. The nip rollers 14 and 15 then stop until the actuating device 25 passes the proximity switch 24 once again. The number which is preselected in the window 30 is related to the size of the printing plate 12 and the number can be adjusted until a satisfactory succession of images is produced by the print cylinder 10, with the repeat distance being such that the succeeding images neither overlap one another nor leave a significant amount of wasted web between images.

Movement of the nip rollers 16 and 17 continues until the web has moved a predetermined distance after the electronic detection device 33 has detected the leading edge of an image which has been printed by the print cylinder 10. This distance is again preselected by selecting an appropriate number in the window 30 of the associated comparator 29, the distance corresponding to the length of the image which is being printed by the print cylinder 10.

Because the nip rollers 16 and 17 move the web until the leading edge of an image is in register with the device 33 and then continue to move the web for a distance which can be adjusted to be exactly equal to the size of the image, the second colour can be very accurately printed on to the image. The control of the web past the cylinder 11 can be quite independent of the control of the web past the cylinder 10 because of the interposed accumulator device 19. Indeed it is possible to have any desired number of additional accumulator devices 19, and additional print cylinders with their associated parts, making it possible to print any desired number of colours very accurately.

Figure 3:
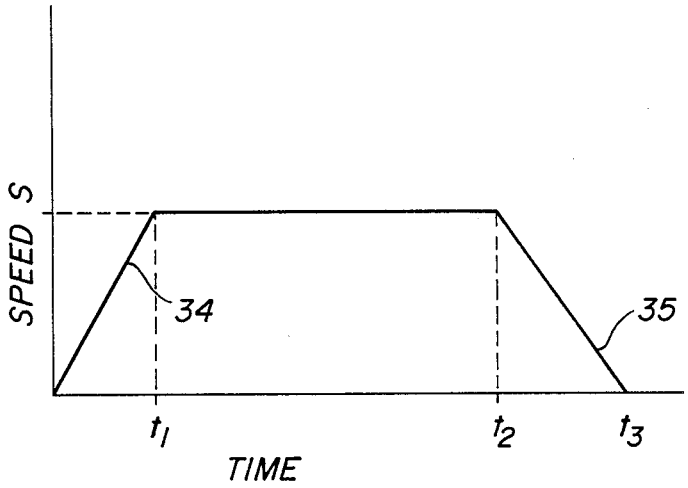
FIG. 3 is a graph related to the movement of the web being printed by the apparatus.

The operation of the servo motors will now be described in more detail, with reference to the graph shown in FIG. 3, which is a graph of the speed of a given nip roller with respect to time, during a given cycle.

The portion of the graph 34 illustrates the nip roller accelerating up to its normal speed S over a time T1. The portion of the graph 35 represents the deceleration of the nip roller between times T2 and T3.

The nip rollers are conventionally driven from a main drive shaft by engaging a clutch and are decelerated back to zero by disengaging the clutch and engaging a brake. The time period T1, and the time period T3 minus T2, is a measure of the slip that takes place in the clutch and the brake respectively, and this slip varies from cycle to cycle. The accuracy of repeatability of the slip is 7½%. It will be appreciated that if the slip varies slightly from cycle to cycle, the exact position of the web cannot be guaranteed during any given cycle and this can lead to slight misalignment of images, particularly when a large number of colours are being printed.

In conventional apparatus, to try to make the effect of this alteration of slip as small as possible, the time periods T1 and T3 minus T2 are reduced as much as possible, by reducing as much as possible the inertia of the nip rollers.

We have now discovered however that by driving the nip rollers using servo motors, this gives much greater accuracy of repeatability of the acceleration and deceleration times.

Each servo motor is associated with a digital encoder which produces pulses related to the rotation of the motor. These pulses are fed to a control circuit which controls the motor in dependence upon the rate at which the pulses are produced.

For example, the control circuit of the motor can be preset to ensure that the motor reaches its normal speed S after 100 pulses have been generated by the encoder. Since the number of pulses generated is directly related to the distance travelled by the nip roller, and hence the distance travelled by the web, the amount to which the web will move during a given cycle can be accurately predetermined. For example if the motor initially accelerates too slowly, the slow rate of pulse production will be detected by the control circuit and the control circuit will speed the motor up. Conversely, if the motor initially accelerates too quickly, the control circuit will slow it down. Thus the total time period for a cycle, namely T3, and hence the distance that the web will move during the time period T3, can be very accurately controlled, since the control circuit of the motor controls the deceleration of the motor in exactly the same way, in dependence upon the pulses produced by the servo motor.

The invention is not restricted to the details of the foregoing embodiment. For example, there is a slight possibility that a small amount of slip may take place between the web and the nip rollers. The digital encoders may be driven by an independent roller or other gripping device arranged to make contact with the web with substantially no slip between the web and the contact device.

I claim:

1. Apparatus for printing a succession of images onto an elongated web in at least two colors, said apparatus comprising:

first and second rotatable printing cylinders each having a printing plate thereon;

drive means for continuously driving said first and second rotatable print cylinders;

first intermittent feed and impressing means for intermittently feeding said elongated web past said first rotatable print cylinder and impressing said web on said plate on said first print cylinder to cause said printing plate on said first rotatable print cylinder to apply a first color image to said elongated web;

second intermittent feed and impression means for intermittently feeding said elongated web past said second rotatable print cylinder and impressing said web on said plate on said second print cylinder to cause said printing plate on said second rotatable print cylinder to apply a second color image to said elongated web;

first control means for stopping said first intermittent feed means to interrupt movement of said elongated web past said first rotatable print cylinder after said printing plate on said first print cylinder has printed a first color image on said elongated web;

second control means for stopping said second intermittent feed means to interrupt movement of said elongated web past said continuously driven second rotatable print cylinder after said printing plate on said second print cylinder has printed a second color image on said first color image on said elongated web; and web length accumulation means for permitting the length of said elongated web extending between said first and second feed means to accumulate and to deplete as either one or both of said first and second intermittent feed means feed said elongated web past said first and second continuously rotatable print cylinders, respectively.

2. Apparatus as claimed in claim 1, wherein said web length variation means is arranged between said first and second rotatable print cylinders.

3. Apparatus as claimed in claim 2, wherein said web length variation means is an accumulator device.

4. Apparatus as claimed in claim 1, wherein said first intermittent feed and impression means includes a first servo motor and said second intermittent feed and impression means includes a second servo motor, each of said servo motors including a pulse generating digital encoder and means for feeding digitally generated pulses from said first and second motor digital encoders to said first and second servo motors, respectively, to control each said servo motor dependent upon the rate at which said respective servo motor produces such pulses.

5. Apparatus for printing a succession of images onto an elongate web in at least two colors, said apparatus comprising:

first and second rotatable print cylinders each having a printing plate thereon;

drive means for continuously driving said first and second rotatable print cylinders;

first intermittent feed and impressing means for intermittently feeding said elongate web past said first rotatable print cylinder and impressing said web on said plate of said first print cylinder to cause said printing plate on said first rotatable print cylinder to apply a first color image to said elongate web;

second intermittent feed and impression means for intermittently feeding said elongate web past said second rotatable print cylinder and impressing said web on said plate on said second print cylinder to cause said printing plate on said second rotatable print cylinder to apply a second color image to said elongate web;

first control means for stopping said first intermittent feed means to interrupt movement of said elongate web past said first rotatable print cylinder after said printing plate on said first print cylinder has printed a first color image on said elongate web;

second control means for stopping said second intermittent feed means to interrupt movement of said elongate web past said continuously driven second rotatable print cylinder after said printing plate on said second print cylinder has printed a second color on said first color image on said elongated web;

web length accumulation means for permitting the length of said elongate web extending between said first and second feed means to accumulate and to deplete as either one or both of said first and second intermittent feed means feed said elongate web past said first and second continuously rotating print cylinders, respectively;

means for producing a first digital count related to the desired size of said first color image; and digital encoding means for producing a second digital count related to the distance moved by said elongate web between interruptions of movement, said stopping of said first and second means for intermittently feeding by said first and second control means taking place when said first and second digital counts are the same.

6. Apparatus according to claim 5, wherein a servo motor is associated with said digital encoding means.

7. Apparatus for printing a succession of images onto an elongate web in at least two colors, said apparatus comprising:

first and second rotatable print cylinders each having a printing plate thereon;

drive means for continuously driving said first and second rotatable print cylinders;

first intermittent feed and impressing means for intermittently feeding said elongate web past said first rotatable print cylinder and impressing said web on said plate of said first print cylinder to cause said printing plate on said first rotatable print cylinder to apply a first color image to said elongate web;

second intermittent feed and impression means for intermittently feeding said elongate web past said second rotatable print cylinder and impressing said web on said plate on said second print cylinder to cause said printing plate on said second rotatable print cylinder to apply a second color image to said elongate web;

first control means for stopping said first intermittent feed means to interrupt movement of said elongate web past said first rotatable print cylinder after said printing plate on said first print cylinder has printed a first color image on said elongate web;

second control means for stopping said second intermittent feed means to interrupt movement of said elongate web past said continuously driven second rotatable print cylinder after said printing plate on said second print cylinder has printed a second color on said first color image on said elongated web;

web length accumulation means between said first and second rotatable print cylinders for permitting the length of said elongate web extending between said first and second feed means to accumulate and to deplete as either one or both of said first and second intermittent feed means feed said elongate web past said first and second continuously rotating print cylinders, respectively;

means for producing a first digital count related to the desired size of said first color image; and digital encoding means for producing a second digital count related to the distance moved by said elongate web between interruptions of movement, said stopping of said first and second means for intermittently feeding by said first and second control means taking place when said first and second digital counts are the same;

said first intermittent feed and impression means includes a first servo motor and said second intermittent feed and impression means includes a second servo motor, each of said servo motors including a pulse generating digital encoder and means for feeding digitally generated pulses from said first and second motor digital encoders to said first and second servo motors, respectively, to control each said servo motor dependent upon the rate at which said respective servo motor produces such pulses.

8. A method of printing a succession of images onto an elongate web in at least two colors, said method comprising:

providing first and second feeding means for feeding said elongate web successively past first and second rotatable print cylinders each having a printing plate thereon providing a web length variation means, applying a first color image to said web by said printing plate on said first rotatable print cylinder and applying a second color image to said web by said printing plate on said second rotatable print cylinder;

periodically interrupting movement of said elongate web past said first and second rotatable print cylinders, permitting the length of said elongate web extending between said first and second feed means to be varied by said web length variation means, thereby enabling said feeding of said elongate web past one of said first and second rotatable print cylinders to be interrupted regardless of whether the feed of said elongate web past the other of said first and second rotatable print cylinders have been interrupted, controlling a repeat distance between said color images applied to said elongated web by controlling the length of said interruptions of movement of said elongate web past said second rotatable print cylinder in dependence upon the size of said first color image.

9. A method as claimed in claim 8, wherein a cycle is commenced by starting said first and second feed means simultaneously.

10. A method as claimed in claim 9, wherein said first feed means is stopped after said elongate web has moved a predetermined distance past said first rotatable print cylinder.

11. A method as claimed in claim 10, in which said second feed means is associated with a detection device for detecting said first color image produced by said first rotatable print cylinder, said second feed means being stopped after said elongate web has travelled a predetermined distance after said detection device has detected said first color image.

12. A method as claimed in claim 11, in which said predetermined distances are measured using a digital encoding device which produces a digital count related to the distance moved by said elongate web.

13. A method as claimed in claim 12, in which means are provided for presetting a desired count relating to a desired distance and comparing the desired count with the count produced by the digital encoding device.

14. A method of printing a succession of images onto an elongate web in at least two colors, said method comprising:

feeding said elongate web successively past a first rotatable print cylinder having a printing plate thereon, a web length variation means and a second rotatable print cylinder having a printing plate thereon, applying a first color image to said elongate web by said printing plate on said first printing cylinder, and applying a second color image to said elongated web by said printing plate on said second rotatable print cylinder;

periodically interrupting said feeding of said web past said first and second rotatable print cylinders, permitting the length of said elongate web extending between said first and second rotatable print cylinders to be varied by said web length variation means, thereby enabling said elongate web to be fed past one of said first and second rotatable print cylinders regardless of whether or not said elongate web is being fed past the other of said first and second rotatable print cylinders;

producing a first digital count related to the desired size of said first color image; and producing a second digital count related to the distance moved by said elongate web between interruptions of movement, said interruptions taking place when said first and second digital counts are the same.

15. A method as claimed in claim 14, wherein said second digital count is produced by a digital encoding device.

16. A method as claimed in claim 15, wherein a servo motor is associated with said digital encoding device.

* * * * *